United States Patent [19]

Matsumoto et al.

[11] Patent Number: 4,853,640

[45] Date of Patent: Aug. 1, 1989

[54] SYNCHROTRON RADIATION SOURCE

[75] Inventors: Manabu Matsumoto, Ibaraki; Takashi Ikeguchi, Hitachi; Shinjiroo Ueda, Abiko; Tadasi Sonobe, Iwaki; Toru Murashita, Atsugi; Satoshi Ido, Isehara; Kazuo Kuroishi, Hitachi; Yoshiaki Kazawa, Hitachi; Shunji Kakiuchi, Hitachi; Toshiaki Kobari, Ibaraki, all of Japan

[73] Assignees: Hitachi, Ltd.; Nippon Telephone & Telegraph; Hitachi Service Engineering, Ltd., all of Tokyo, Japan

[21] Appl. No.: 155,120

[22] Filed: Feb. 11, 1988

[30] Foreign Application Priority Data

| | | | |
|---|---|---|---|
| Feb. 12, 1987 | [JP] | Japan | 62-28281 |
| Mar. 18, 1987 | [JP] | Japan | 62-60981 |
| Jul. 22, 1987 | [JP] | Japan | 62-181015 |

[51] Int. Cl.[4] ..... H05H 13/04; H01J 7/16

[52] U.S. Cl. ..... 328/235; 313/7; 328/233

[58] Field of Search ..... 313/7; 328/235, 233

[56] References Cited

U.S. PATENT DOCUMENTS

| | | | |
|---|---|---|---|
| 4,024,426 | 5/1977 | Vaguine | 328/233 X |
| 4,477,746 | 10/1984 | Piltch | 315/39 |
| 4,631,743 | 12/1986 | Tomimasu et al. | 328/233 X |
| 4,737,727 | 4/1988 | Yamada et al. | 328/235 |

FOREIGN PATENT DOCUMENTS

| | | | |
|---|---|---|---|
| 0648020 | 8/1981 | U.S.S.R. | 328/235 |

OTHER PUBLICATIONS

"Status of the Vacuum System in the Photon Factory Electron Storage Ring", by H. Kitamura et al, National Laboratory for High Energy Physics Report (1984), pp. 234–236.

"ESR Vacuum System for the Photon Factory", by M. Kobayashi et al, *Nuclear Instruments and Methods,* 177 (1980), pp. 111–115.

"Design of a Synchrotron Radiation Facility for Orsay's ACO Storage Ring: Lure", by. P. M. Guyon et al, *Review of Scientific Instruments,* vol. 47, No. 11, pp. 1347–1356, Nov. 1976, Publisher: American Institute of Physics.

*Primary Examiner*—Palmer C. DeMeo

*Attorney, Agent, or Firm*—Antonelli, Terry & Wands

[57] ABSTRACT

An industrial compact synchrotron radiation source which can improve vacuum evacuation performance to prolong life-time of a charged particle beam and supply highly intensive stable synchrotron radiation. In the source, a charged particle beam bending duct forming a vacuum chamber through which the charged particle beam circulates is encompassed by a bending electromagnet, and at least one SR guide duct for guiding the radiation to outside extends from the outer circumferential wall of the bending duct. The SR guide duct is connected through a gate valve to an SR beam line duct for guiding the SR beam to an object to be worked and a vacuum pump is disposed on the side, close to an orbit of the charged particle beam, of the gate valve. The SR guide duct extending from the outer circumferential wall of the bending duct takes a form of a divergent duct which is widened in accordance with a spreading angle of the SR beam traveling through the SR guide duct.

16 Claims, 7 Drawing Sheets

SYNCHROTRON RADIATION SOURCE

BACKGROUND OF THE INVENTION

This invention relates to a synchrotron radiation (SR) source and more particularly to an industrial, compact SR source having an improved vacuum evacuation system which can attain vacuum evacuation performance suitable for this type of SR source.

As discussed in "Proceeding of the 5th Symposium on Accelerator Science and Technology" in the high energy laboratory reports, 1984, pp. 234–236, conventional accelerators and large-scale SR sources are known wherein bending sections, each of which deflects the orbit of a charged particle beam for causing the synchrotron radiation to be taken out of the source, are not collectively disposed in a relatively short range of the beam duct, but disposed with spaces between them where straight sections are disposed so that the bending sections are uniformly distributed as a whole in the beam duct.

Accordingly, sources of gases discharged from the interior wall surface of the charged particle beam bending duct under the irradiation of synchrotron radiation are substantially uniformly distributed along the orbit of the charged particle beam and besides gases discharged from the bending sections under the irradiation of the synchrotron radiation can be evacuated by not only built-in pumps installed inside the beam duct of the charged particle bending section but also vacuum pumps installed in an adjacent straight section, thereby ensuring that the charged particle beam bending duct can be maintained at high vacuum and a long lifetime of the charged particle beam can be maintained.

In compact SR sources for industrial purposes, however, because of a limited installation space and desirable cost reduction, the bending section for delivery of synchrotron radiation has to be laid concentratedly.

Taking a compact SR source comprised of two straight sections and two bending sections, for instance, it is necessary for one bending section to 180° deflect the charged particle beam orbit and as a result, the amount of gases generated by each bending section under the irradiation of synchrotron radiation upon the interior wall surface of a charged particle beam bending duct is increased extremely, reaching about 10 times the amount of discharged gases generated by each bending section in the case of the large-scale SR source.

Accordingly, if the vacuum evacuation system of the large-scale SR source is directly applied to the compact SR source without alternation, then sufficient evacuation capability will not be obtained to thereby raise a problem that pressure in the charged particle beam bending duct rises and a desired lifetime of the charged particle beam can not be obtained.

Further, in the large-scale SR source, the bending angle is small, leading to a small spreading angle of the synchrotron radiation beam guided to the outside through SR guide duct and hence a crotch can be provided at an outlet window to the SR guide duct to restrict the SR beam in order to avoid the irradiation of the SR beam upon the interior wall surface of the SR guide duct and consequently prevent outgasing inside the SR guide duct under the irradiation of the SR beam, as discussed in "Nuclear Instruments and Methods 177", 1980, pp. 111–115. The provision of the crotch is very effective for differential evacuation between an SR beam line in which pressure is relatively high and the charged particle beam bending duct in which high vacuum must maintain.

Contrarily, in the industrial compact SR source, the bending sections for delivery of the synchrotron radiation are laid concentratedly because of a limited installation space and desirable cost reduction and hence the bending angle of each bending section is increased to a great extent.

In addition, since in the compact SR source the number of bending sections is limited, one bending section is provided with a plurality of SR guide ducts for guiding the synchrotron radiation to the outside. Because of the large spreading angle of the SR beam travelling through each of the guide ducts, the interior surface of each guide duct is irradiated with the SR beam to discharge a large amount of gases into each guide duct.

In the compact SR source, therefore, while the reduction in size limits the installation space of vacuum pumps, a large amount of gases are generated concentratedly, with the result that the charged particle beam bending duct can not be evacuated sufficiently, raising problems that residual gaseous molecules disturb the circular motion of the charged particle beam and a desired long lifetime of the beam cannot be obtained.

SUMMARY OF THE INVENTION

The present invention contemplates elimination of the above problems and has for its object to provide a synchrotron radiation source capable of improving vacuum evacuation performance so as to prolong lifetime of the charged particle beam and supply highly intensive and stable synchrotron radiation.

According to the invention, to accomplish the above object, in a synchrotron radiation source comprising a charged particle beam duct forming a vacuum chamber through which a charged particle beam circulates and encompassed with a bending electromagnet, at least one SR guide duct extending from the outer circumferential wall of the beam duct, for guiding an SR beam to the outside, and an SR beam line duct connected to the SR guide duct through a gate valve, a vacuum pump is disposed on the side, close to the orbit of the charged particle beam, of the gate valve and the SR guide duct extending from the outer circumferential wall of the beam duct takes the form of a divergent duct which is widened in accordance with a spreading angle of the synchrotron radiation beam travelling through the SR guide duct.

DESCRIPTION OF THE PREFERRED EMBODIMENTS

The invention will now be described by way of example with reference to the accompanying drawings.

Figure 1:
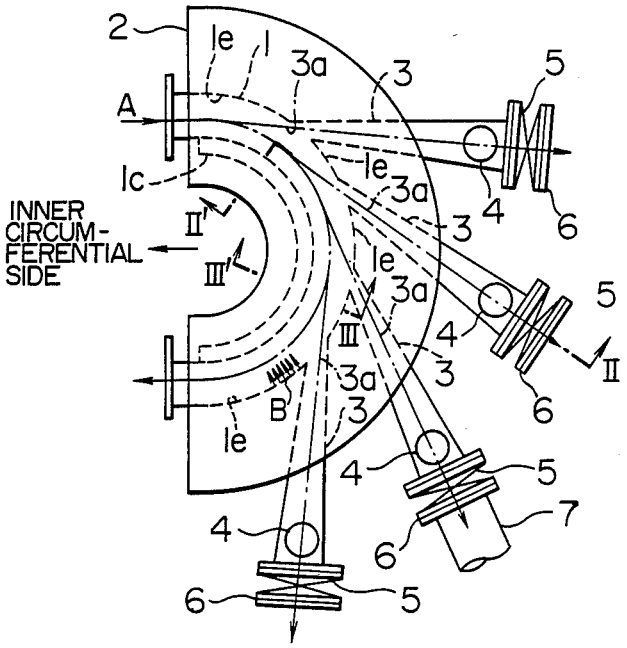
FIG. 1 is a plan view illustrating a half of a bending section of an SR source according to an embodiment of the invention.

Referring now to FIG. 1, there is illustrated a bending section of industrial compact SR source incorporating a vacuum evacuation system according to an embodiment of the invention. In FIG. 1, 1 is a charged particle beam duct or a bending duct so referred to hereinafter which is used to form a loop-like vacuum beam duct through which a charged particle beam such as an electron beam can circulate. In this embodiment, the loop-like beam duct has two bending sections and two straight sections to form a circular orbit of the beam but only one bending section or duct having a bending angle of 180° is illustrated in FIG. 1. Thus, the bending duct 1 has the form of a semi-circular ring which is encompassed with a C-shaped core 2 of a bending electromagnet in such a manner that the center axis of the bending duct 1 substantially coincides with the center of a magnetic field generated by the bending electromagnet.

Formed in the outer circumferential wall of the bending duct 1 are windows 3*a* with which SR guide ducts 3 communicate. The guide ducts 3 are adapted to guide the synchrotron radiation taken out through the windows 3*a* toward the outside of the SR source and extend from the windows, in parallel with the plane including the orbit of the charged particle beam and tangentially to the bending duct 1, to pass through the core 2 of the bending electromagnet. The outer end of each guide duct 3 is closed, when not used, by a gate flange 5 and a check valve 6. As shown, as an example, in one of the SR guide ducts 3 in FIG. 1, when it is desired to communicate any guide duct 3 with an SR beam line 7 to be used by a user of the synchrotron radiation, the SR beam line 7 is connected to the gate valve 5 after removing the check flange 6. The SR guide duct 3 has a rectangular crosssection, having upper and lower surfaces or walls parallel to the charged particle beam orbit plane which are gradually widened toward the gate valve 5, and consequently the guide duct 3 generally takes a form of a divergent duct which is widened in accordance with the spreading of the SR beam. More specifically, the guide duct 3 is a flattened divergent duct which extends from the window or branching point outwards with only its walls parallel to the charged particle beam orbit plane widened or enlarged as the extension proceeds. This configuration of the guide duct 3 can prevent the SR beam from directly irradiating the inner wall of the guide duct. Further, in this embodiment, a vacuum pump 4 is mounted on the outer wall of the SR guide duct 3 between the outer edge of the core 2 of electromagnet and the flange 6 closer to the charged particle beam orbit.

The manner of mounting the vacuum pump 4 will be described specifically with reference to FIG. 2.

Figure 2:
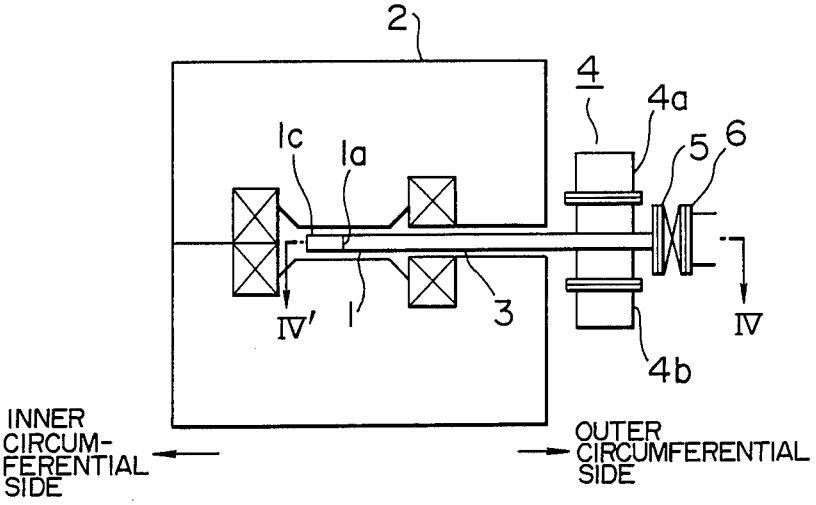
FIG. 2 is a sectional view taken along the line II-II' of FIG. 1.

As illustrated in FIG. 2, the vacuum pump system 4 includes an upper ion pump 4*a* and a lower titanium getter pump 4*b* which are respectively mounted to the ducts extending outwardly from and perpendicular to the upper and lower walls of the guide duct 3. By the vacuum pump system 4 in this way, the SR beam can be prevented from directly irradiating the interior of the vacuum pumps 4*a* and 4*b*. Preferably, the vacuum pumps 4*a* and 4*b* are mounted as close as possible to the bending duct 1, with minimal room required for assembling the core 2 of the bending electromagnet, ion pump 4*a* and titanium getter pump 4*b*.

Figure 3:
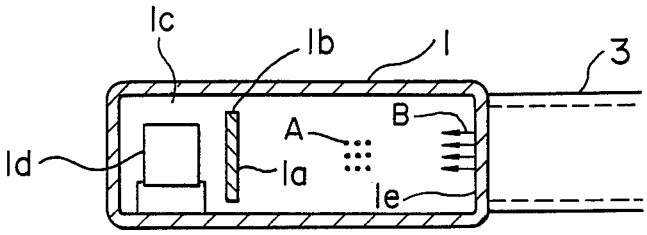
FIG. 3 is a sectional view taken along the line III-III' of FIG. 1.

The bending duct 1 is exaggeratedly illustrated in FIG. 3.

As shown, a partition wall 1*a* having many of upper and lower gas communication perforations 1*b* defines a chamber 1*c* within the bending duct 1, the chamber 1*c* extending along the inner circumferential wall of the bending duct 1 substantially over the whole length of the bending section. Disposed in the chamber 1*c* is a non-vaporable type getter pump 1*d*.

Figure 4:
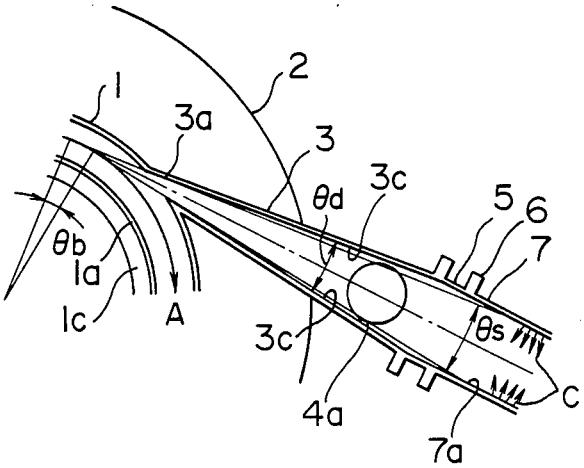
FIG. 4 is a sectional view taken along the line IV-IV' of FIG. 2.

FIG. 4 shows the relation between a divergent angle of the SR guide duct 3 and the synchrotron radiation beam. Among the synchrotron radiation radiated from the charged particle beam tangentially to the orbit A of the charged particle beam along which the charged particle beam travels, the SR beam having a spreading angle $\theta s$ equal to a bending angle $\theta b$ determined from the geometrical relation between an aperture size of the window 3*a* and a curvature of the orbit is admitted to the SR beam line 7 through the guide duct 3. Under this condition, the divergent angle $\theta d$, of the guide duct 3 is related to $\theta s$ by $$\theta d > \theta s \quad (1)$$

indicating that the cross-section of the guide duct 3 parallel to the plane of the charged particle beam orbit is broadened outwardly at an angle which is slightly larger than the spreading angle of the synchrotron radiation beam.

The operation and effect of this embodiment will now be described. With reference to FIG. 1, when a charged particle beam enters the bending duct 1, it is bent by the magnetic field generated by the bending electromagnet 2 to trace the orbit A, with the result that the direction of the charged particle beam is changed by 180° from the entrance to the exit. As the charged particle beam is gradually bent, the synchrotron radiation is radiated from the charge particle beam tangentially to the orbit A. The radiation is partly guided toward the outside through the outlet window 3*a* and the guide duct 3 and partly irradiates directly upon the interior surface of the outer circumferential wall 1*e*, of the bending duct 1 to cause outgasing of a large amount of gaseous molecules in the directions shown by arrow B on the basis of a photo-excited separation phenomenon.

Generally, for calculation of the amount Q of gases discharged from a material under the irradiation of an SR beam, the SR beam is quantized so as to be represented by a number of photons, thereby determining the number np of photons irradiated per unit time, which is multiplied by a gas discharge coefficient n characteristic of the material, so that $$Q = \eta np \quad (2)$$

is obtained. The photon number np is proportional to energy E of the charged particle beam and charged particle current T as indicated by $$np = kEI \quad (3)$$

where k is constant, and the radiation is uniformly distributed over the bending section.

The above relationship indicates that the amount of discharged gases does not depend on the distance from the radiation source, namely, the charged particle beam orbit A but is proportional to a bending angle of the charged particle beam corresponding to the flux of the radiation beam irradiated on the interior surface of the outer circumferential wall 1*e* of the bending duct 1. For example, assuming that the gas discharge coefficient $\eta$ remains unchanged, the ratio of the amount of gases generated in the bending duct 1 to the amount of gases generated in the guide duct 3 and the following member is equal to the ratio of a circumferential length of the outer circumferential wall 1*e* of the bending duct 1 to a circumferential length of the outlet window 3*a*, thus indicating that a large amount of gases are generated in the member other than the bending duct 1. Since the interior wall surface of the SR guide duct 3 is not irradiated directly with the SR beam as described previously, the interior surface of the check flange 6 and the SR beam line 7 and the following member (the gate valve 5 is normally opened and during the work for connection to the SR beam line 7, it is closed) mainly act as sources of gases generated in the member following the guide duct 3.

Gases generated in the bending duct 1 are mainly evacuated by the built-in type non-vaporable getter pump 1*d*. The getter pump 1*d* is installed in a narrow space and is structurally difficult to achieve optimized performance. In addition, the conductance for evacuation is decreased by the partition wall 1*a* adapted to prevent the synchrotron radiation reflected at the interior surface of the wall 1*e* and/or the photoelectrons excited from that interior surface under the irradiation of the synchrotron radiation from stimulating the gas adsorbing surface of the pump 1*d* and consequently causing re-discharge of gases from the adsorbing surface. For these reasons, the getter pump 1*d* is insufficient for evacuation.

The vacuum pump system 4, on the other hand, is operative to evacuate gases generated near the check flange 6. Because of the provision of the vacuum pump 4, gas loading on a built-in pump conventionally used to evacuate the gases near the check flange can be reduced considerably. Since evacuation capacity of the vacuum pump system 4 can be selected suitably, a vacuum pump system 4 of large capacity can be employed with a view of evacuating gases in the bending duct 1 through the SR guide duct 3. Thus, the conventional built-in pump and the vacuum pump 4 can cooperate with each other to evacuate gases prevailing in the bending duct 1, thereby improving evacuation capability for the bending section.

The evacuation capability for the bending section can be further improved by the advantageous configuration of the SR guide duct 3 and the preferable mount position of the vacuum pump 4 as described hereinbefore.

More particularly, the divergent guide duct 3 permits a discharge gas source to be concentrated near the check flange 6 and also provides, near the flange, a large crosssectional area which can facilitate evacuation. On the other hand, by mounting the vacuum pump 4 as close as possible to the bending section, the conductance between the bending duct 1 and vacuum pump 4 can be increased and consequently gases in the bending duct 1 can be evacuated at an increased effective evacuation rate.

These advantages all contribute to improving efficiency of evacuating the interior of the bending duct 1.

Since the evacuation efficiency for the bending section can be improved in this manner, pressure in the bending duct 1 forming the charged particle beam orbit can be reduced sufficiently and lifetime of the charged particle beam can be prolonged considerably.

At the same time, variations in the reduced pressure due to the presence or absence of the SR beam line 7 in use can be mitigated by the vigorous evacuation based on the vacuum pump 4 and hence stable lifetime of the charged particle beam can advantageously be obtained. Further, even in the event of failure of the built-in pump, an abrupt increase in pressure can be avoided by the evacuation by means of the vacuum pump 4 and therefore the adverse influence upon equipments associated with the SR beam line 7 can be suppressed to advantage.

In addition, the improved evacuation efficiency attributable to the provision of the vacuum pump 4 demonstrates itself especially during operation immediately following the initial assembling of the SR source, as will be described below.

Figure 5:
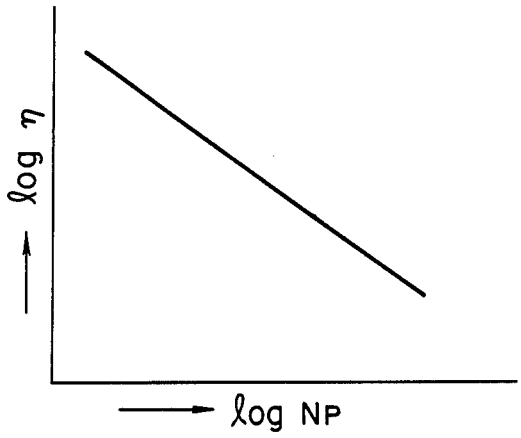
FIG. 5 is a graph showing an example of outgasing characteristic of a material under the irradiation of the synchrotron radiation.

The gas discharge coefficient $\eta$ described in the equation (2) is a function, as graphically shown in FIG. 5, of the accumulated number Np of photons, which is integral of the number of irradiated photons np in the equation (3) by time $\pi$, that is, $$Np = \int np d\pi \quad (4)$$

FIG. 5 indicates that on logarithmic coordinates the gas discharge coefficient $\eta$ on ordinate decreases substantially linearly with the accumulated photon number Np on abscissa increasing.

Under an insufficiently reduced pressure acting on the charged particle beam orbit lifetime of the charged particle beam is short and a large amount of current can not be sustained. This requires that injection of electrons be repeated frequently. Accordingly, the accumulated photon number obtained from the equations (3) and (4) can not be increased and the efficiency $\eta$ can not be decreased sufficiently, with the result that the pressure decrease with time is retarded. This condition repeats itself and as a result, it takes a very long time, in an order of years, to obtain a desired amount of beam current with a large-scale SR source.

Especially, in the initial stage, since no synchrotron radiation is available due to shorter life-time of the charged particle beam, the warming-up operation of the source is carried out with the check flange unremoved. In such a case, by taking advantage of the high evacuation capability according to the invention, the pressure can be reduced sufficiently during the warming-up operation and the resulting prolongation of lifetime of the charged particle beam and decreased amount of discharged gases in combination operate positively to provide desired beam current and life at a delay of short period of time.

The life of the non-vaporable getter pump is shortened when used under an insufficiently reduced pressure But, by operating the vacuum pump 4, the operation can be kept continuing even when the pressure reduction is insufficient and the non-vaporable getter pump 1*d* is stopped.

Generally, approximately a half of the total amount of gases discharged due to the synchrotron radiation is derived concentratedly from only one bending section. But, in this embodiment, the synchrotron radiation is guided to the outside through the four SR guide ducts 3 and therefore gas discharge can be shared by the SR guide duct by an amount proportional to the total bending angle 4θb and the remaining amount is shared by the bending duct 1.

Referring to FIG. 3, the gases B discharged into the bending duct 1 under the irradiation of the synchrotron radiation upon the interior surface of the outer circumferential wall 1*e* of the bending duct 1 flow into the pump chamber 1*c* through the gas communication perforations 1*b*, and they are partly evacuated by the non-vaporable pump 1*d* and partly drawn to the opposite ends of the bending duct 1 and evacuated by pumps such as ion pumps installed in straight section ducts (not shown) connected to the opposite ends. The partition wall 1*a* is effective to prevent reflected radiation and/or photoelectrons from stimulating the non-vaporable getter pump 1*d* and consequently re-discharge of gases once adsorbed on this pump can be avoided.

In the SR guide duct system, on the other hand, the radiation is prevented, pursuant to the relation indicated by equation (1), from irradiating the guide duct 3 directly but directed on the interior surface 7*a* of the following SR beam line 7, as shown in FIG. 4. As a result, the radiations and/or photoelectrons cause gases C to be discharged from the beam line 7 and the discharged gases are evacuated by the vacuum pump 4 and a pump (not shown) installed in the line 7.

Figure 6:
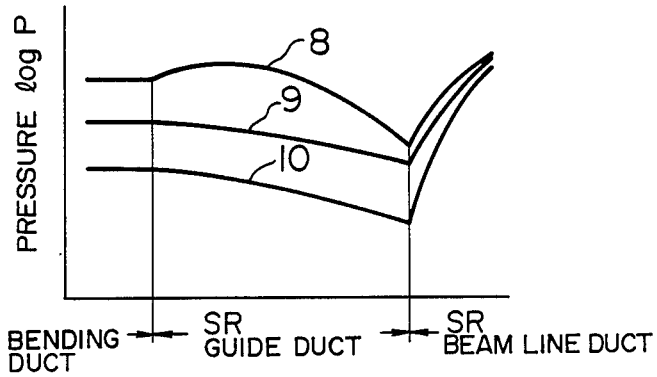
FIG. 6 is a graph showing pressure distributions in the bending section of the invention.

The evacuation is carried out in this way to establish pressure distributions as shown in FIG. 6 within the bending duct 1.

In FIG. 6, a curve 8 is representative of a pressure distribution in an SR source having an SR guide duct which extends from an outlet window 3*a* without diverging. In this case, the synchrotron radiation irradiates the interior surface, as designated by 3C in FIG. 4, of the guide duct and gases are discharged therein. Because the guide duct has a small conductance for evacuation and the effective evacuation rate of the vacuum pump 4 is therefore degraded for gases discharged into the guide duct, these discharged gases partly flow into the bending duct 1. In the bending duct 1, discharged gases predominatingly prevail but the gas communication perforations 1*b* are small and the non-vaporable getter pump 1*d* forced to have limited capacity because of the narrow installation space can not evacuate gases at a high effective evacuation rate. This condition is aggravated by the inflow of the discharged gases from the SR guide duct, resulting in insufficient evacuation and a consequent increase in pressure.

In contrast, with the divergent SR guide duct 3, the flow path can be widened to increase the conductance and the gas discharge source can be concentrated near the vacuum pump 4, thereby establishing a pressure distribution as represented by a curve 9 in FIG. 6 which proves that the effective evacuation rate of the vacuum pump 4 is increased. In addition, the amount of gases discharged into the guide duct 3 is very small and the pressure in the guide duct 3 has no maximum. This means that the vacuum pump 4 can afford to evacuate the discharged gases prevailing in the bending duct 1. Accordingly, the evacuation capability for the bending duct 1 can be improved and pressure in the bending duct 1 can be reduced sufficiently.

Furthermore, in this embodiment, the vacuum pump 4 principally engages in evacuating gases discharged from the source which lies outwardly of the outer circumferential edge of the bending electromagnet core and a space outward of the outer circumferential edge is sufficiently large to mount the vacuum pump 4. Accordingly, pumps of large evacuation capacity can be used as the ion pump 4*a* and getter pump 4*b*, so that the evacuation capability for the bending duct 1 can be further increased to reduce the pressure to a great extent as indicated by a distribution curve 10 in FIG. 6.

If, as in the case of the large-scale SR source, the crotch is disposed at the outlet window 3*a* to restrict the beam and the SR guide duct 3 is constructed as a parallel duct having a large width sufficient to escape the irradiation of the synchrotron radiation, vacuum evacuation performance comparable to that of the present embodiment may be obtained. However, to meet the compact SR source in which the spreading angle of the SR beam is large, the width of the parallel duct must be increased correspondingly to a great extent, requiring that the core be cut away at its portions near the bending duct 1. Such a core will invite non-uniformity of magnetic flux density and consequent unstable circular motion of the charged particle beam. Obviously, the divergent guide duct 3 of the present embodiment can eliminate the above disadvantages and improve the vacuum evacuation performance without adversely effecting the circular motion of the charged particle beam.

Putting aside the evacuation performance, the present embodiment can attain additional effects as will be described below.

Generally, the surface irradiated by the synchrotron radiation undergoes irradiation of high energy photons to act as a high-temperature heat source and the back of the surface must be cooled. In the particular case of the SR guide duct, a very bad condition for heat dissipation also persists because the interior surface of the guide duct is exposed to high vacuum and the exterior surface is encompassed with the core of the bending electromagnet. This requires that the guide duct be cooled when irradiated by the synchrotron radiation. However, the interior surface of the guide duct 3 according to the present embodiment is free from the radiation and the guide duct 3 can therefore dispense with cooling means which would otherwise be required to be installed in a narrow space.

Secondly, in some applications, the spreading angle of the SR beam is desired to be large in order to match a large mount space of a spectroscope and a mirror which are handled by the user or to meet other purposes. According to the present embodiment, the synchrotron radiation passed through the outlet window 3*a* can all be guided to the outside without being shielded in the guide duct 3 and can be utilized effectively for the above applications.

In the foregoing embodiment, the bending section having four SR guide ducts 3 each mounted with one titanium getter pump 4*b* and one ion pump 4*a* has exemplarily been described. Practically, however, the number of guide ducts 3 is so determined as to meet the demand of the user. Since the ratio of gas discharging rate at the bending section to gas discharging rate at the SR guide duct system varies depending on the number of guide ducts 3 as described previously, evacuation specifications of the vacuum pump 4 are so selected as to match the number of guide ducts 3 and the gas discharging rate in order to obtain the same effects as those described previously. Accordingly, the number of guide ducts 3, the number of vacuum pumps and the type of the pump are not limited in the present invention.

The bending angle of the charged particle beam has been described as being 180° in the foregoing embodiment but it may be changed without changing the evacuation system scheme purporting that the vacuum pump 4 is mounted to the SR guide duct 3, though in some instances the number of guide ducts is limited by the bending angle.

As the built-in pump installed in the bending duct 1, a distributed ion pump utilizing a leakage magnetic field of the bending electromagnet 2 may be used in place of the non-vaporable getter pump 1*d* exemplified in the foregoing embodiment. Further, an absorber made of a material which inherently discharges a small amount of gases under the irradiation of the synchrotron radiation may be applied on the interior surface, which generally receives the synchrotron radiation, of the outer circumferential wall of bending duct 1 in order to suppress outgasing, with a view of prolonging lifetime of the charged particle beam. In any case, the essential construction described in connection with the foregoing embodiment can be applied without alteration.

Figure 7:
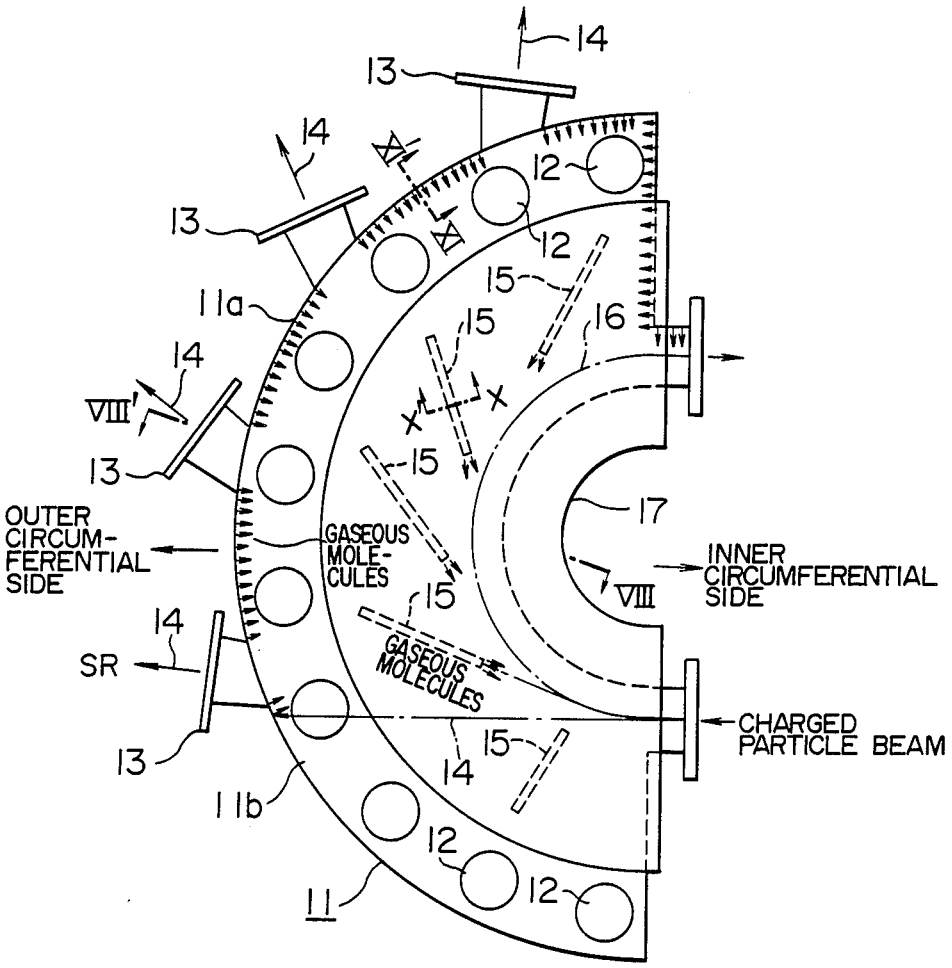
FIG. 7 is a plan view illustrating a half of a bending section of an SR source according to another embodiment of the invention.
Figure 8:
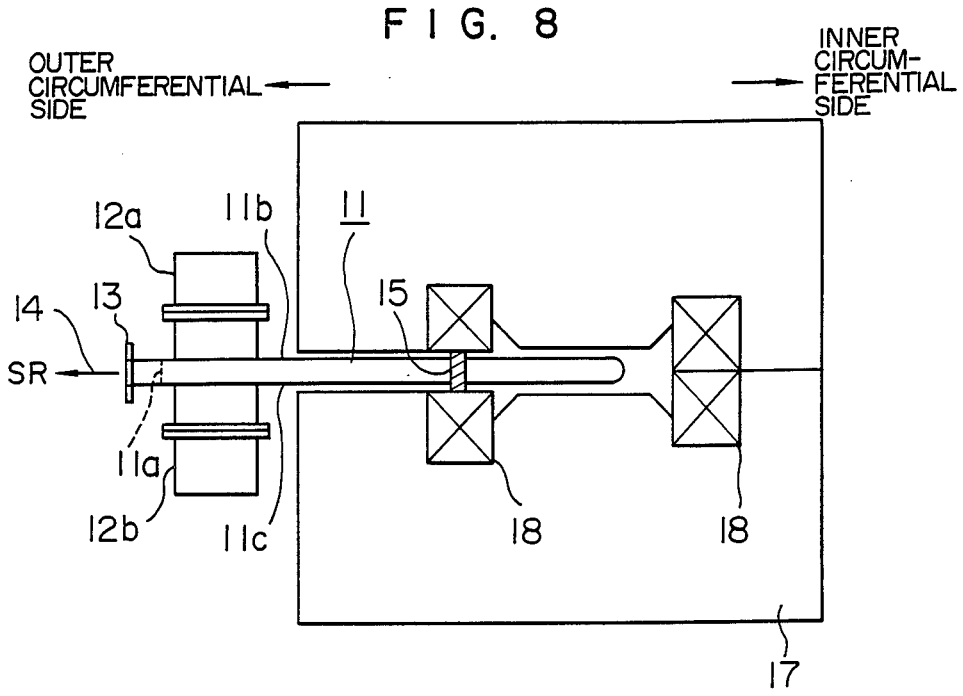
FIG. 8 is a sectional view taken along the line VIII-VIII' of FIG. 7.

Referring to FIG. 7, a bending section of industrial compact SR source according to another embodiment of the invention will now be described. In FIG. 7, a bending duct 11 takes the form of a substantially C-shaped semi-circle and has one end at which a charged particle beam enters the bending duct and the other end at which the charged particle beam leaves the bending duct. The outer circumferential wall 11*a* of the bending duct 11 protrudes beyond the outer circumferential edge of a core 17 of a bending electromagnet, not shown. Four SR guide ducts 13 extend from the outer circumferential wall 11*a*. Ten vacuum pump sets 12 are provided each set including, as shown in FIG. 8, an ion pump 12*a* mounted to the upper end surface 11*b* of the bending duct 11 and a titanium getter pump 12*b* mounted to the lower end surface 11*c*. For simplicity of production of the bending duct 11, the vacuum pump sets 12 are disposed at equal circumferential intervals.

Inside the bending duct 11, elongated supports 15 bridge the upper and lower walls of the bending duct and protrude through these walls to support the bending electromagnet. The supports 15 longitudinally extend, at positions remote from the outer circumferential wall 11*a* of the bending duct 11, in a direction which is parallel to the SR beam. Each support 15 is provided at a position intermediate to adjacent two of the SR guide ducts 13.

For better understanding of the overall construction of the bending duct, reference should be made to FIG. 8. In this illustration, the bending electromagnet is designated by reference numeral 18 and associated with the core 17 to form a magnetic circuit.

The bending duct 11 is inserted between upper and lower halves of the core 17 and bending electromagnet 18, and the bending electromagnet 18 is supported by the supports which vertically protrude through the bending duct 11.

The ion pump 12*a* and titanium getter pump 12*b* of each vacuum pump set 12 are respectively mounted to the upper and lower end surfaces contiguous to the outer circumferential wall 11*a* of the bending duct 11. Since the vacuum pump sets 12 are mounted to the end portion in this way, their interior can obviously escape the direct irradiation of the synchrotron radiation 14.

Figure 9:
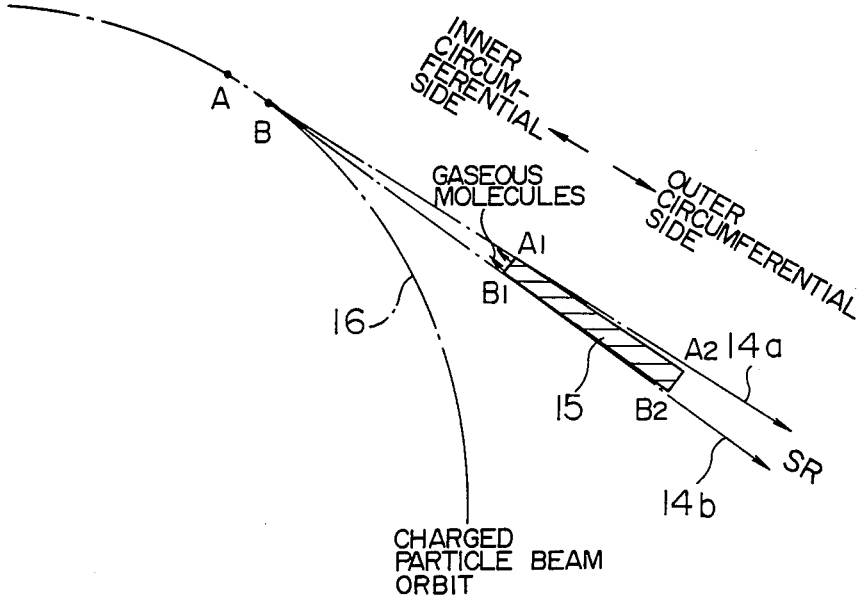
FIG. 9 is an enlarged plan view showing a part of the SR source of FIG. 7.

The configuration of the support 15 will now be detailed with reference to FIG. 9. The support 15 shown in FIG. 7 is positionally related to an orbit 16 of the charged particle beam and the synchrotron radiation 14, as diagrammatically shown in FIG. 9.

SR beams 14*a* and 14*b* respectively stemming from points A and B on the charged particle beam orbit 16 reach end points Al and Bl, close to the inner circumferential wall of the bending duct 11, of the support 15. Line segments AA1 and BB1 are representative of tangents at the points A and B on the orbit 16, respectively, and coincide with the trace of the synchrotron radiation 14. End points A2 and B2, close to the outer circumferential wall of the bending duct 11, of the support 15 lie within a region between extensions of the line segments AA1 and BB1, so that opposite side surfaces A1A2, B1B2 and the outer end surface A2B2 can escape the direct irradiation of the radiation 14.

Since the synchrotron radiation 14 directly irradiates the inner end surface A1B1 of the support 15 and the interior surface of the outer circumferential wall 11*a* of the bending duct 11, the support 15 and bending duct 11 are cooled so as not to be heated under exposure to the radiation 14.

Figure 10:
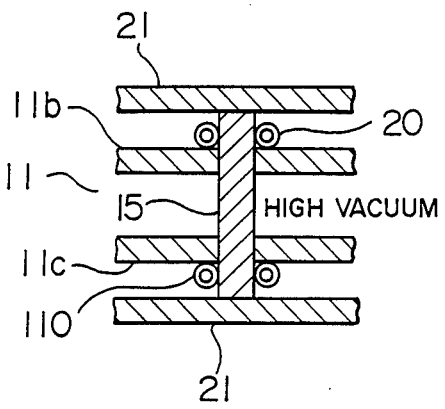
FIG. 10 is a sectional view taken along the line X-X' of FIG. 7.

FIG. 10 illustrates a water cooling structure for the support 15.

As shown in FIG. 10, the support 15 vertically protruding through the bending duct 11 is welded to a coil vacuum chamber 21 forming a part of the bending electromagnet 18. Between the bending duct 11 and opposing halves of the coil vacuum chamber 21, a water cooling pipe 20 is laid in intimate contact with the support 15 and the upper and lower surfaces 11*b*, 11*c* of the bending duct 11 to cool the support 15 and bending duct 11. Thus, the water colling pipe 20 is laid not in high vacuum but in the atmospheric pressure.

Figure 11:
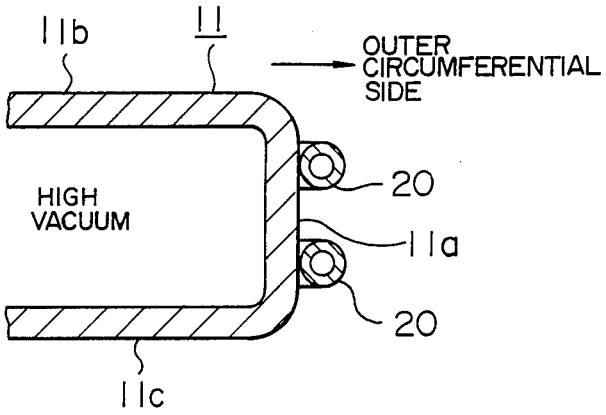
FIG. 11 is a sectional view taken in the line XI-XI' of FIG. 7.

FIG. 11 illustrates a cooling structure for the outer circumferential wall 11*a* of the bending duct 11.

As shown in FIG. 11, a cooling water pipe 20 is welded to the exterior surface of the outer circumferential wall 11*a* of bending duct 11 to cool the bending duct 11. This cooling pipe 20 is also laid not in high vacuum but in the atmospheric pressure.

The operation and effect of this embodiment will now be described.

As shown in FIG. 7, a charged particle beam entering the bending duct 11 traces the nearly circular orbit 16 under the influence of a magnetic field generated from the bending electromagnet and leaves the exit of the bending duct 11.

The synchrotron radiation 14 is radiated tangentially of the charged particle beam orbit 16. The radiation 14 is partly guided to the outside through the SR guide duct 13 and partly irradiated directly on the interior surface of the outer circumferential wall 11*a* of bending duct 11 and the inner end surface of the support 15 to cause outgasing of a large amount of gaseous molecules in directions of small arrow on the basis of the photo-excited separation phenomenon. The area of the interior surface of outer circumferential wall 11*a* being remote from the charged particle beam orbit 16 and irradiated with the synchrotron radiation is much larger than the area of the inner end surface of support 15 being close to the orbit 16 and irradiated by the radiation. Therefore, most of gases prevailing in the bending duct 11 are discharged from a gas discharge source on the interior surface of outer circumferential wall 11*a*.

Since a number of vacuum pumps 12 disposed close to the outer circumferential wall 11*a* of bending duct 11 then lie in the vicinity of the gas discharge source, discharged gaseous molecules can immediately be evacuated to the outside of the SR source.

The vacuum pump 12 disposed near the gas discharge source can have a larger effective evacuation rate than is disposed at an other site and advantageously the SR source can be maintained under high vacuum condition and lifetime of the charged particle beam can be prolonged. Most of gas discharge sources are remote from the charged particle beam orbit 16 and gases discharged from these courses can hardly affect the charged particle beam adversely.

As described in connection with FIG. 9, the support 15 extends substantially in parallel to the SR beam and only its inner end surface is irradiated directly with the radiation with the result that the amount of gas discharged from the support 15 under the irradiation of the synchrotron radiation can be minimized. Usually, the material surface is thermally excited to discharge gases but the outgasing rate in thermal discharge is about 1/100 of that in direct irradiation by the synchrotron radiation and need not be considered particularly.

Due to the fact that the synchrotron radiation is radiated tangentially of the charged particle beam orbit 16, the source of gases discharged under the irradiation of the synchrotron radiation is predetermined at the interior surface of bending duct 11 near the exit of the charged particle beam orbit 16, as illustrated in FIG. 7. However, a large amount of gases discharged near the exit of the orbit 16 can partly be evacuated by means of vacuum pumps 12 which are disposed closer to the entrance of the charged particle beam than to the exit, and which share less gas loading per pump, by way of a space between the outer circumferential wall of the bending duct 11 and the outer ends of supports 15 which are spaced apart from the outer circumferential wall 11*a*, thereby ensuring that pressure difference inside the bending duct 11 can be minimized, in other words, pressure in the bending duct 11 can approach uniformity so as to contribute to prolongation of lifetime of the charged particle beam.

Portions irradiated directly by the synchrotron radiation are cooled with water as shown in FIGS. 10 and 11 to suppress outgasing at these portions and prevent burn-out damage of these portions. The provision of the water colling pipe not in the high vacuum pressure but in the atmospheric pressure can improve reliability of the bending duct 11.

The ion pump 12*a* and titanium getter pump 12*b* respectively mounted to the upper and lower surfaces 11*b* and 11*c* of bending duct 11 can be inspected for maintenance with ease.

Figure 12:
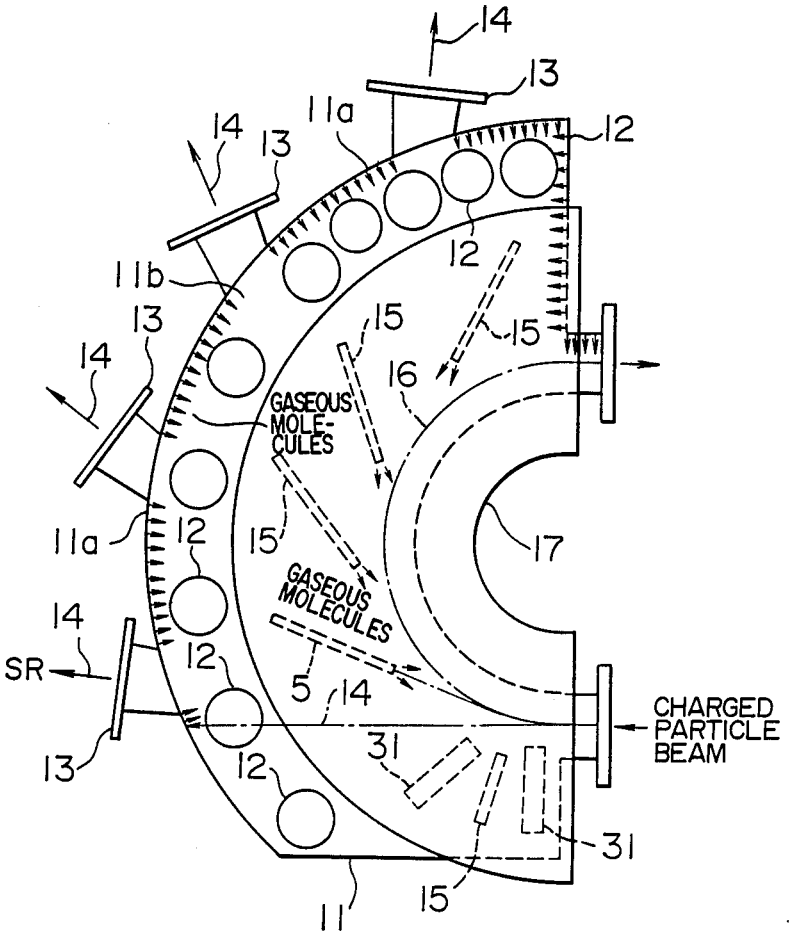
FIG. 12 is a plan view illustrating a half of a bending section of an SR source according to still another embodiment of the invention.

FIG. 12 shows still another embodiment of the bending section according to the invention. In FIG. 12, members corresponding to those of FIG. 7 are designated by identical reference numerals.

Referring to FIG. 12, the outer circumferential wall 11*a* of the bending duct 11 does not complete a semi-circular configuration but is cut away near the entrance of the charged particle beam. In this configuration, ten vacuum pump sets 12, identical in number to the vacuum pump sets in the embodiment of FIG. 7 are employed and disposed densely near the exit of the charged particle beam orbit in contrast to the uniform distribution of the vacuum pump sets in the embodiment of FIG. 7. Specifically, two vacuum pump sets are moved to the neighborhood of the exit.

Built-in pumps 31 such as non-vaporable getter pumps are disposed in the bending duct 11 near the entrance of the charged particle beam at positions where the built-in pumps can escape direct irradiation of the synchrotron radiation.

The operation and effect of this embodiment will now be described.

Since the vacuum pump sets 12 are densely disposed near the exit of the charged particle beam orbit 16 where the amount of gases discharged under the irradiation of the synchrotron radiation is large, pressure in the bending duct 11 can be more reduced near the exit as compared to the embodiment of FIG. 7. Near the entrance, the built-in pumps 31 play the part of two vacuum pumps 12 now removed from there to maintain substantially the same pressure as that in the FIG. 7 embodiment, leading to an advantage that pressure in the bending duct 11 can be more uniformed and more reduced as compared with the embodiment of FIG. 7.

Further, due to partial cutting of the outer circumference of the bending duct 11, the overall size of the SR source can be reduced advantageously.

The embodiments of FIG. 7 and 12 may be combined together. For example, in the embodiment of FIG. 7, additional vacuum pumps may be provided near the exit of the charged particle beam to further reduce the pressure in the SR source or built-in pumps may be provided near the entrance of the charged particle beam.

The number of vacuum pumps to be installed depends on a value of pressure in the bending duct which is required for determining lifetime of the charged particle beam. In order to prolong the beam lifetime, many vacuum pumps each having a large evacuation rate may be disposed along the outer circumferential wall of the bending duct and built-in pumps may be provided near the entrance of the charged particle beam at positions where the built-in pumps can escape direct irradiation of the synchrotron radiation.

Thus, to meet a desired vacuum pressure level in the bending duct, an optimum number of vacuum pumps may be provided at optimum positions along the outer circumferential wall of the bending duct.

As described above, in the synchrotron radiation source of the invention, a charged particle beam bending duct forming a vacuum chamber through which a charged particle beam circulates is encompassed with a bending electromagnet, and at least one SR guide duct for guiding the radiation to the outside extends from the outer circumferential wall of the bending duct. The SR guide duct is connected through a gate valve to an SR beam line duct for guiding the SR beam to an object to be worked and a vacuum pump is disposed on the side, close to an orbit of the charged particle beam, of the gate valve. Preferably, the SR guide duct extending from the outer circumferential wall of the bending duct takes the form of a divergent duct which is widened in accordance with a spreading angle of the SR beam travelling through the SR guide duct. With the above construction, the vacuum evacuation performance for the bending duct can be improved to obtain high vacuum inside the bending duct and consequently prolong lifetime of the charged particle beam. Thus, the SR source can afford to supply highly intensive stable synchrotron radiation.

We claim:

1. A synchrotron radiation source comprising:
a charged particle beam bending duct forming a vacuum chamber through which a charged particle beam circulates and encompassed with a bending electromagnet;
at least one SR guide duct extending from the outer circumferential wall of said bending duct, for guiding synchrotron radiation of the outside of said bending duct;
an SR beam line duct connected to said SR guide duct through a gate valve, for guiding the radiation to an object to be worked; and
a vacuum pump disposed on the side, close to an orbit of the charged particle beam, of said gate valve.

2. A synchrotron radiation source according to claim 1 wherein said vacuum pump is mounted to said SR guide duct between said gate valve and bending electromagnet.

3. A synchrotron radiation source according to claim 2 wherein said vacuum pump is mounted to said SR guide duct in close proximity to said bending electromagnet.

4. A synchrotron radiation source according to claim 2 wherein said vacuum pump comprises vertically opposing halves mounted to said SR guide duct between said gate valve and bending electromagnet.

5. A synchrotron radiation source according to claim 4 wherein said vertically opposing halves of said vacuum pump are disposed in spaced relationship to the upper and lower surfaces of said SR guide duct.

6. A synchrotron radiation source according to claim 2 wherein a second vacuum pump is disposed inside said bending duct near the inner circumferential wall thereof.

7. A synchrotron radiation source according to claim 6 wherein inside said bending duct, a chamber is defined along the inner circumferential wall of said bending duct by a partition wall having upper and lower gas communication perforations, and said second vacuum pump is disposed in said chamber.

8. A synchrotron radiation source according to claim 1 wherein the outer circumferential wall of said bending duct protrudes beyond the outer circumferential edge of said bending electromagnet, and a plurality of vacuum pumps are mounted to the exterior end surface of said bending duct contiguous to the outer circumferential wall.

9. A synchrotron radiation source according to claim 8 wherein inside said bending duct, supports for supporting said bending electromagnet are disposed substantially tangentially of the charged particle beam orbit at positions where said supports do not block the synchrotron radiation directed to said SR guide duct.

10. A synchrotron radiation source according to claim 9 wherein each of said supports longitudinally extends to the neighborhood of the outer circumferential edge of said bending electromagnet and near the interior surface of the outer circumferential wall of said bending duct, a space is formed through which gaseous molecules prevailing in said bending duct can freely move circumferentially.

11. A synchrotron radiation source according to claim 8 wherein said vacuum pumps are disposed densely near the exit of the charged particle beam orbit.

12. A synchrotron radiation source according to claim 8 wherein built-in pumps are disposed inside said bending duct near the entrance of the charged particle beam orbit at positions where said built-in pumps escape direct irradiation of the synchrotron radiation.

13. A synchrotron radiation source according to claim 1 wherein the outer circumferential wall of said bending duct protrudes beyond the outer circumferential edge of said bending electromagnet, and a plurality of vacuum pumps are mounted to said bending duct outwardly of a core forming said bending electromagnet.

14. A synchrotron radiation source comprising:
a charged particle beam bending duct forming a vacuum chamber through which a charged particle beam circulates and encompassed with a bending electromagnet;
at least one SR guide duct extending from the outer circumferential wall of said bending duct for guiding synchrotron radiation, which extends tangentially of an orbit of the charged particle beam circulating through said bending duct, to the outside of said bending duct, said SR guide duct taking a form of a divergent duct which is gradually widened toward its outlet end along a spreading direction of said synchrotron radiation;
an SR beam line duct connected said SR guide duct through a gate valve, for guiding the radiation to an object to be worked; and
a vacuum pump disposed on the side, close to an orbit of the charged particle beam, of said gate valve.

15. A synchrotron radiation source A synchrotron radiation source comprising:
a charged particle beam bending duct forming a vacuum chamber through which a charged particle beam circulates and encompassed with a bending electromagnet;
at least one SR guide duct extending from the outer circumferential wall of said bending duct for guiding synchrotron radiation, which extends tangentially of an orbit of the charged particle beam circulating through said bending duct, to the outside of said bending duct, said SR guide duct taking a form of a divergent duct which is gradually widened toward its outlet end along a spreading direction of said synchrotron radiation;
wherein on a plane sectioning said SR guide duct in parallel to a plane of the charged particle beam orbit, said SR guide duct has a divergent angle which is larger than a spreading angle of the synchrotron radiation travelling through said SR guide duct so that a cross-section of said SR guide duct parallel to the plane of the charged particle beam orbit is broadened outwardly at the divergent angle which is larger than the spreading angle of the synchrotron radiation.

16. A sychrotron radiation source comprising:
a charged particle beam bending duct forming a vacuum chamber through which a charged particle beam circulates and encompassed with a bending electromagnet;
at least one SR guide duct extending from the outer circumferential wall of said bending duct, for guiding synchrotron radiation to the outside of said bending duct;
an SR beam line duct connected said SR guide duct through a gate valve, for guiding the an SR beam to an object to be worked, said SR guide duct taking a form of a divergent duct which is gradually widened toward said gate valve; and
a vacuum pump disposed on the side, close to an orbit of the charged particle beam, of said have valve.

* * * * *